US007609985B2

(12) United States Patent
Tateishi et al.

(10) Patent No.: US 7,609,985 B2
(45) Date of Patent: Oct. 27, 2009

(54) FIXING APPARATUS HAVING DETERMINATIION OF CLEANING MEMBER SMEARING AND IMAGE FORMING APPARATUS

(75) Inventors: Yoshinobu Tateishi, Nara (JP); Toyoaki Nanba, Osaka (JP); Tadasu Taniguchi, Nara (JP); Toshiya Mikita, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 97 days.

(21) Appl. No.: 12/043,249

(22) Filed: Mar. 6, 2008

(65) Prior Publication Data

US 2008/0226363 A1 Sep. 18, 2008

(30) Foreign Application Priority Data

Mar. 14, 2007 (JP) ..... 2007-065507

(51) Int. Cl.
*G03G 15/20* (2006.01)

(52) U.S. Cl. ..... 399/33; 399/34; 399/327

(58) Field of Classification Search ..... 399/31, 399/33, 34, 36, 67, 324–327; 219/216; 118/60, 118/70, DIG. 1; 702/41; 101/423, 424.2, 101/425; 15/256.5, 256.51, 256.52
See application file for complete search history.

(56) References Cited

U.S. PATENT DOCUMENTS 5,229,817 A * 7/1993 Lange et al. ..... 399/34
5,464,474 A * 11/1995 Nishimoto et al. ..... 118/676
5,600,424 A * 2/1997 Malachowski ..... 399/68
5,842,418 A * 12/1998 Corrado et al. ..... 101/425
6,032,016 A * 2/2000 Morigami et al. ..... 399/325
6,035,174 A * 3/2000 Ito et al. ..... 399/328
6,154,619 A * 11/2000 Boockholdt et al. ..... 399/24
7,113,717 B2 * 9/2006 Bott et al. ..... 399/67
2007/0269229 A1 * 11/2007 Maeda et al. ..... 399/33
2008/0260405 A1 * 10/2008 Carolan et al. ..... 399/67

FOREIGN PATENT DOCUMENTS

JP 05011670 A * 1/1993
JP 08-095413 4/1996
JP 08160818 A * 6/1996
JP 09236958 A * 9/1997
JP 2001005353 A * 1/2001
JP 2001-166626 6/2001
JP 2006322995 A * 11/2006

* cited by examiner

*Primary Examiner*—Robert Beatty
(74) *Attorney, Agent, or Firm*—Remmer, Otto, Boisselle & Sklar, LLP

(57) ABSTRACT

A fixing apparatus is provided with a fixing roller that fixes a toner image that has been transferred onto a paper, a cleaning member that cleans a circumferential surface of the fixing roller using a metal roller that is idly rotated by contacting the circumferential surface of the fixing roller, a drive control means that, at a predetermined timing, sets a rotation velocity of the fixing roller to high-speed rotation that is faster by a predetermined velocity than a rotation velocity during print processing, a load torque detection means that detects a load torque of a drive source of the fixing roller, and a determination means that determines an extent of smearing of the cleaning member based on a load torque detected by the load torque detection means during high-speed rotation by the drive control means.

12 Claims, 11 Drawing Sheets

FIXING APPARATUS HAVING DETERMINATIION OF CLEANING MEMBER SMEARING AND IMAGE FORMING APPARATUS

BACKGROUND OF THE INVENTION

This application claims priority under 35 U.S.C. § 119(a) on Patent Application No. 2007-065507 filed in Japan on Mar. 14, 2007, the entire contents of which are herein incorporated by reference.

The present invention relates to fixing apparatuses in which a metal roller is arranged that is idly rotated by contacting a circumferential surface of a fixing roller, which fixes a toner image that has been transferred onto a paper, and that is provided with a cleaning member for cleaning the circumferential surface of the fixing roller using the metal roller, and to image forming apparatuses equipped with these fixing apparatuses.

These image forming apparatuses are provided with fixing apparatuses that melt and fasten unfixed toner onto paper. In this type of fixing apparatus, a thermal fixing roller system is employed in which, while the paper is transported with being sandwiched in a pressing area (fixing nip portion) between a hot roller and a pressure roller, the paper is subjected to heat and pressure by the hot roller and the pressure roller so that toner on the paper is thermally melted and fixed there.

In these thermal fixing roller system fixing apparatus, the surfaces of both rollers are heated by a heat source (heater) that is arranged inside the hot roller. And toner on the paper that is being transported is melted at the fixing nip portion and fastened (fixed) onto the paper. At this time, not all the unfixed toner on the paper is fastened onto the paper, and some adheres to the pressure roller via the hot roller and the fixing nip portion. For this reason, cleaning members are arranged for the hot roller and the pressure roller respectively in order to clean "smeared toner" that is in an adhered state thereon. Of these, a metal roller that is idly rotated by contacting the circumferential surface of the pressure roller is generally used as the cleaning member for cleaning the surface of the pressure roller.

In recent years, double sided printing has become possible as part of the increasing multifunctionality of image forming apparatuses. In the case of double sided printing, since there is image information (a toner image) also on the unfixed surface (pressure roller side) of the transported paper, toner in a half-melted state adheres to the pressure roller side also due to the surface temperature of the pressure roller and the pressure that is applied at the fixing nip portion when the paper passes through the fixing nip portion in this state.

In this case, although it is possible to arrange a large-scale cleaning member (such as a web cleaning unit) as the cleaning member arranged for the pressure roller in a same manner as on the hot roller side, this would not only result in an apparatus of a larger size, but would also result in an increased load on the drive source of the apparatus, and therefore ordinarily it is common for the aforementioned metal roller to be used as the cleaning member on the pressure roller side.

Accordingly, fixing apparatuses aimed at improving the cleaning capabilities of metal rollers such as these have heretofore been proposed (for example, see JP 2001-166626A). In this fixing apparatus, the surface temperature of the pressure roller is maintained constantly at a fixed temperature (for example, 150° C.) such that smeared toner that adheres to the pressure roller is put into a melted state, thereby aiming to improve the collection efficiency of the metal roller, which is the cleaning member arranged on the circumference of the pressure roller.

In this regard, in a case where the aforementioned double sided printing is used more frequently, the amount of toner that adheres to the pressure roller also increases, and therefore when cleaning with only the metal roller, the metal roller becomes badly smeared before the metal roller replacement cycle arrives, which is set at the design stage of the apparatus, such that there are problems involving reverse movement of smeared toner to the hot roller and an increased probability that back side smearing will occur on the transported papers. Moreover, when aiming to improve the collection efficiency of the metal roller as indicated in the above-mentioned JP 2001-166626A, the metal roller replacement cycle is further shortened, and therefore occurrences such as reverse movement of smeared toner to the hot roller and back side smearing on the transported papers also become more frequent.

In this case, when smearing of the metal roller exceeds a certain fixed level in a conventional image forming apparatus, deterioration of image quality is prevented by forcibly stopping (locking) the driving of the apparatus. However, for a user, the sudden stopping of the apparatus is unexpected and it would be convenient if some notice or warning was given in advance.

As a technique for carrying out these notices and warnings, a technique has been implemented in which the metal roller replacement cycle is set using an added number of printed sheets for example, and in a case where this is set such that replacement is performed at 100,000 sheets for example, notice is given of the replacement time when the added number of print processed sheets reaches 80,000 sheets for example.

However, as mentioned above, the extent of smearing on the metal roller is greatly different between a case in which double sided printing is frequently used and a case in which it is not, and therefore a technique of giving notice by simply using an added number of printed sheets is merely a notice for reassurance and offers little reliability. Furthermore, although it is possible to issue notices and warnings by actually detecting smearing on the paper, this necessitates mechanisms and circuit configurations for detecting ink smearing on the paper and also necessitates a determination technique for determining smearing, and therefore is not a very realistic technique.

On the other hand, as shown in FIG. 11, which shows a relationship between metal roller smearing and a locking phenomenon of a fixing drive source, a load state of a fixing drive portion is such that the load gradually increases from an initial state of an installation time or a maintenance completion time of the image forming apparatus. As described earlier, a hot roller, a pressure roller, a web cleaning unit, which is the cleaning member for the hot roller side, and a metal roller, which is the cleaning member for the pressure roller side, are ordinarily arranged as rotating members in a fixing apparatus. Of these, the web cleaning unit is rotated at a same velocity as the hot roller using independent driving so that an unsoiled, fresh sheet is always supplied to the hot roller surface, and therefore a load increase at the contact area between the web cleaning unit and the hot roller is inconceivable. Furthermore, the surface of the hot roller is cleaned by the web cleaning unit and the surface of the pressure roller is also cleaned by the metal roller, and therefore as long as the cleaning is carried out reliably, there is little probability of a load increase in either of the hot roller or the pressure roller by themselves. Consequently, it is conceivable that a major cause of the load increase in the fixing drive portion is that an outer diameter of the metal roller, which is arranged at the circumference of the pressure roller and is idly rotated, increases due to collecting smeared toner, thereby resulting in an increase in the contact pressure between itself and the pressure roller. In other words, it is conceivable that the extent of smearing of the metal roller is evident as a load increase in the fixing drive portion.

SUMMARY OF THE INVENTION

The present invention has been devised giving attention to these points and it is an object thereof to provide a fixing apparatus and an image forming apparatus that detect the extent of smearing of the metal roller using a simple technique involving monitoring of load increases in the fixing drive portion without adding new mechanisms or circuits, and can appropriately carry out notices and warnings for such actions as replacing the metal roller before paper smearing occurs.

In order to address these issues, a fixing apparatus according to the present invention is provided with: a fixing roller that fixes a toner image that has been transferred onto a paper, a cleaning member that cleans a circumferential surface of the fixing roller using a metal roller that is idly rotated by contacting the circumferential surface of the fixing roller, a drive control means that, at a predetermined timing, sets a rotation velocity of the fixing roller to high-speed rotation that is faster by a predetermined velocity than a rotation velocity during print processing, a load torque detection means that detects a load torque of a drive source of the fixing roller, and a determination means that determines an extent of smearing of the fixing roller based on a load torque detected by the load torque detection means during high-speed rotation by the drive control means.

Here, a rotation velocity of the high-speed rotation may be set within a range of 1.3 to 2.0 times a rotation velocity during the print processing. When the rotation velocity of the high-speed rotation is within a range of 1 to 1.3 times the rotation velocity during print processing (hereinafter also referred to as "processing velocity") (but less than 1.3 times), no major difference occurs between the load torques and therefore there is a possibility that sufficient detection accuracy will not be obtainable. And when it exceeds 2.0 times, since the rollers then undergo considerably high-speed rotation, there is a possibility that the surfaces of the rollers will be damaged by the paper separation claws that contact the surfaces of hot roller and the pressure roller. Thus, from the perspectives of detection accuracy and preventing component damage, it is preferable that the rotation velocity of high-speed rotation is set to within a range of 1.3 to 2.0 times, and more preferably to within a range of 1.3 to 1.5 times, the processing velocity.

Furthermore, in regard to the metal roller, of a hot roller and a pressure roller that constitute the fixing rollers, the metal roller is contacting the pressure roller, and the drive source is a drive source of the hot roller.

Here, the determination means carries out determination in a following specific manner.

Namely, when a load torque of the drive source detected by the load torque detection means during high-speed rotation of the fixing roller is exceeding a warning detection value that has been set based on a load torque detected by the load torque detection means during print processing, the determination means puts out a notice report of notifying that a timing for replacing or cleaning the cleaning member is approaching.

Furthermore, when a load torque detected by the load torque detection means during print processing is exceeding the warning detection value, the determination means puts out a warning report of warning that it is a timing for replacing or cleaning the cleaning member.

To describe this specifically, as shown in FIG. 4, the load torque of the drive source of the hot roller gradually increases from an initial state of an installation time or a maintenance completion time of the image forming apparatus. Although the increases are shown as being linear in this example, depending on the printing mode the progression of the extent of smearing of the metal roller is in fact not constant, and therefore it is anticipated that the increases will occur in a somewhat curvilinear manner, but here they are shown as being linear in order to simplify description.

Here, a straight line A1, which is indicated by a solid line in the diagram, represents change in the load torque corresponding to the processing velocity, and a straight line A2, which is indicated by a dashed line, represents change in the load torque during high-speed rotation of for example 1.5 times the processing velocity. Furthermore, in this graph are set a locking level, at which the apparatus becomes locked, and a warning level slightly below this level. These levels are obtained by testing in advance the load torque when the driving of the fixing apparatus is stopped due to increased load to the drive source while actually driving the image forming apparatus to carry out printing operations, and the load torque level at this time is set as a locking level Ls and a slightly lower level than the locking level Ls is set as a warning level Lc.

Here, at a timing of a time t3 for example, when the determination means sets the rotation velocity of the fixing roller to high-speed rotation, the load torque at high-speed rotation reaches the warning level Lc and therefore a notice report is carried out at this time. Furthermore, when the load torque reaches the warning level Lc (a time t4) with the rotation velocity during print processing, the determination means puts out a warning report at this time. These notice reports and warning reports may be reports using electronic sounds or reports using voice synthesis, and may be reports in which a message is displayed on a display panel of the image forming apparatus, or may be a report using a combination of these.

Here, the predetermined timing for determining the extent of smearing (such as the time t3 in FIG. 4) may be one or more of the time of a post-printing rotation process in which rotation is performed immediately since completion of print processing, or the time of commencement of motor driving for warming up, or the time of restoring from a power saving mode.

When the predetermined timing is set to a post-printing rotation time in which rotation is performed immediately since completion of print processing, there is an advantage in that in a case where a lot of smeared toner has newly adhered to the metal roller due to the immediately previous print processing, the state of adherence thereof can be determined promptly.

Furthermore, when the predetermined timing is set to the time of commencement of motor driving for warming up, at this point in time the hot roller and the pressure roller are both in a low temperature state and the toner that has adhered to the metal roller has definitely hardened. Thus there is an advantage in that by carrying out high-speed rotation in this state, the influence of smeared toner adhered to the metal roller will more clearly be easily apparent as a change in the load torque of the drive source, and therefore the state of smearing of the metal roller can be detected more accurately.

Furthermore, when the predetermined timing is set to the time of restoring from a power saving mode, at this point in time the hot roller and the pressure roller are both in a low temperature state and the toner that has adhered to the metal roller has definitely hardened in a same manner as for the time of commencement of motor driving for warming up, which is described above. Thus there is an advantage in that by carrying out high-speed rotation in this state, the influence of smeared toner adhered to the metal roller will more clearly be easily apparent as a change in the load torque of the drive source, and therefore the state of smearing of the metal roller can be detected more accurately.

Furthermore, the present invention may be configured such that when apparatus maintenance has been carried out, high-speed rotation control by the drive control means is carried out at a predetermined timing after an added number of print processed sheets since completion of the maintenance has reached a predetermined number of sheets that is set in advance. That is, immediately after maintenance has been carried out there is no smeared toner adhering to the metal roller, and even when some smeared toner adheres thereafter due to print processing, this is within an allowable range of toner adherence for the metal roller. Accordingly, in a case where print processing of 100 sheets for example has been carried out after maintenance, there is no meaning in carrying out the determination process by the determination means at the time of the post-printing rotation process immediately after that printing has finished. Thus, the present invention takes this point into account and, for example, in a case where the targeted replacement cycle of the metal roller is set to an added number of print processed sheets of 100,000 sheets, the predetermined number of sheets is set to 50,000 sheets for example. Then this may be configured such that the determination process according to the present invention is not carried out until 50,000 sheets, and after a stage at which 50,000 sheets has been exceeded and smeared toner has adhered to the metal roller to a certain extent, the determination process may be carried out at the predetermined timing. In this way it is possible to avoid executing the determination process to no purpose immediately after maintenance.

Furthermore, with the present invention, the plurality of types of predetermined number of sheets may be set in advance corresponding to the added number of print processed sheets from after maintenance is finished. In this case, a plurality of interval types of predetermined number of sheets may be set so as to become a smaller sheet number interval as commencement of a next maintenance approaches. And the high-speed rotation control by the drive control means may be configured to be carried out at the predetermined timings each time after the plurality of types of predetermined number of sheets have been reached respectively.

Specifically, when five settings are used for the predetermined number of sheets, these being 50,000 sheets, 60,000 sheets, 65,000 sheets, 68,000 sheets, and 70,000 sheets, a comparison means carries out a first time determination process at the predetermined timing after the added number of print processed sheets has exceeded 50,000 sheets, then the determination process is not carried out until 60,000 sheets, and the determination process is carried out a second time at the predetermined timing after the added number of print processed sheets has exceeded 60,000 sheets, then the determination process is not carried out until 65,000 sheets, and the determination process thereafter is carried out a third time at the predetermined timing after the added number of print processed sheets has exceeded 65,000 sheets, then the determination process is not carried out until 68,000 sheets, and the determination process thereafter is carried out a fourth time at the predetermined timing after the added number of print processed sheets has exceeded 68,000 sheets, then the determination process is not carried out until 70,000 sheets, and the determination process thereafter is carried out a fifth time at the predetermined timing after the added number of print processed sheets has exceeded 70,000 sheets. And there onward, the next maintenance time is approaching, and therefore the determination process may be carried out for each of a predetermined timing. Note however that the above-described specific example is merely one example, and it is also possible to set the predetermined number of sheets thereafter in much finer detail.

On the other hand, contrary to finely setting the predetermined number of sheets in this manner, it is also possible to set a plurality of interval types of predetermined number of sheets to an interval of a fixed number of sheets. For example, after the added number of print processed sheets has exceeded 50,000 sheets, the determination process may be set to be carried out at a predetermined timing thereafter each time 100 sheets are print processed for example.

The present invention may be configured as described above and therefore it is possible to detect the extent of metal roller smearing using a simple technique involving monitoring of load increases in the fixing drive portion without adding new mechanisms or circuits, and notices and warnings for such actions as replacing the metal roller can be carried out appropriately before paper smearing occurs. Furthermore, by carrying out these notices and warnings, it is possible to avoid unnecessary urgent stoppages of the image forming apparatus.

DESCRIPTION OF THE PREFERRED EMBODIMENTS

Hereinafter, an embodiment of the present invention is described in detail with reference to the accompanying drawings.

Overall Description of Image Forming Apparatus

Figure 1:
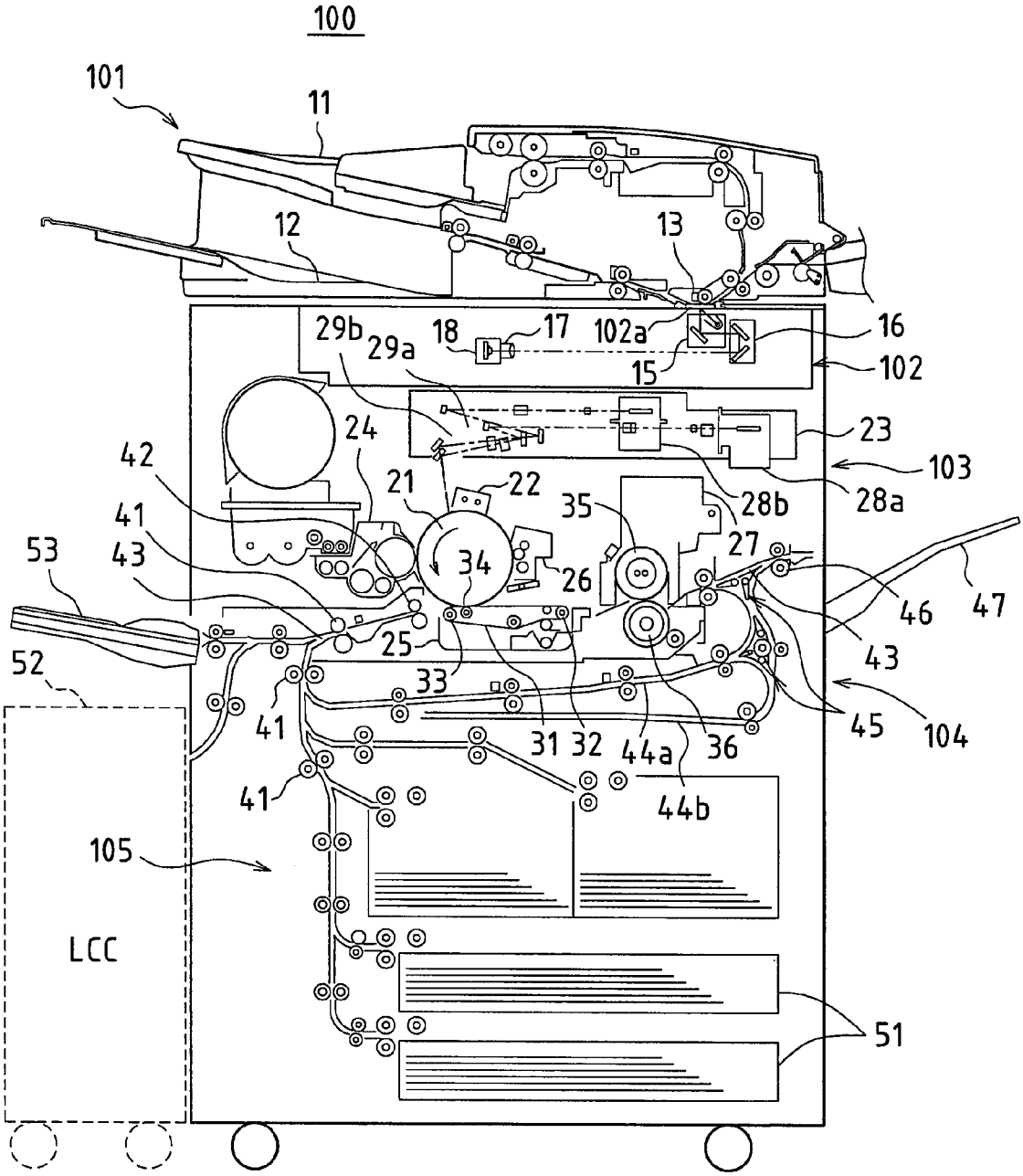
FIG. 1 is a schematic view of an image forming apparatus in which one embodiment of a fixing apparatus according to the present invention has been applied.

FIG. 1 is a schematic view of an image forming apparatus in which one embodiment of a fixing apparatus according to the present invention has been applied.

The image forming apparatus 100 obtains image data that has been read from an original paper or received from outside, and forms a monochrome image indicated by the image data on a recording paper, and its structure can be broadly divided into an original paper transport portion (ADF) 101, an image reading portion 102, a print portion 103, a recording paper transport portion 104, and a paper feed portion 105.

When at least one sheet of an original paper is set in an original setting tray 11 in the original paper transport portion 101, the original paper is withdrawn and transported from the original setting tray 11 sheet by sheet, and the original paper is guided to and made to pass through an original reading window 102*a* of the image reading portion 102, then the original paper is discharged to a discharge tray 12.

A CIS (contact image sensor) 13 is arranged above the original reading window 102*a*. When the original paper passes over the original reading window 102*a*, the CIS 13 repetitively reads in a main scanning direction an image of a back side of the original paper and outputs image data that indicates the image of the back side of the original paper.

Furthermore, when the original paper passes over the original reading window 102*a*, the image reading portion 102 uses a lamp of a first scanning unit 15 to expose the surface of the original paper, then guides reflected light from the surface of the original paper to an imaging lens 17 using mirrors of the first scanning unit 15 and a second scanning unit 16, and an image of the surface of the original paper is imaged onto a CCD (charge coupled device) 18 by the imaging lens 17. The CCD 18 repetitively reads in a main scanning direction an image of the surface of the original paper and outputs image data that indicates the image of the surface of the original paper.

Further still, in a case where the original paper is placed onto a platen glass on an upper surface of the image reading portion 102, the first scanning unit 15 and the second scanning unit 16 are caused to move while maintaining a predetermined velocity relationship such that the surface of the original paper on the platen glass is exposed by the first scanning unit 15 and reflected light from the surface of the original paper is guided to the imaging lens 17 by the first scanning unit 15 and the second scanning unit 16, and an image of the surface of the original paper is imaged onto the CCD 18 by the imaging lens 17.

Image data that has been outputted from the CIS 13 or the CCD 18 undergoes various types of image processing by a control circuit such as a microcomputer and is then outputted to the print portion 103.

The print portion 103 is for recording an original, which is represented by image data, onto paper, and is provided with components such as a photosensitive drum 21, a charging unit 22, an optical writing unit 23, a development unit 24, a transfer unit 25, a cleaning unit 26, and a fixing apparatus 27.

The photosensitive drum 21 rotates in one direction and after its surface is cleaned by the cleaning unit 26, its surface is uniformly charged by the charging unit 22. The charging unit 22 may be a charger type unit or may be a roller type or brush type unit that makes contact with the photosensitive drum 21.

The optical writing unit 23 is a laser scanning unit (LSU) provided with two laser irradiation portions 28*a* and 28*b*, and two mirror groups 29*a* and 29*b*. The optical writing unit 23 receives image data and emits laser beams corresponding to the image data from the laser irradiation portions 28*a* and 28*b* respectively, then these laser beams are irradiated onto the photosensitive drum 21 via the mirror groups 29*a* and 29*b* so that the uniformly charged surface of the photosensitive drum 21 is exposed, thereby forming an electrostatic latent image on the surface of the photosensitive drum 21.

To support high speed print processing, the optical writing unit 23 employs a two beam system provided with the two laser irradiation portions 28*a* and 28*b* such that the irradiation timing is made faster and the load is decreased.

It should be noted that instead of the laser scanning unit, an EL writing head or an LED writing head in which light-emitting elements are lined up in an array may be used as the optical writing unit 23.

The development unit 24 supplies toner to the surface of the photosensitive drum 21 to develop the electrostatic latent image and form a toner image on the surface of the photosensitive drum 21. The transfer unit 25 transfers the toner image on the surface of the photosensitive drum 21 to the recording paper that has been transported in by the recording paper transport portion 104. The fixing apparatus 27 applies heat and pressure to the recording paper to cause the toner image to fix onto the recording paper. After this, the recording paper is further transported and discharged to a discharge tray 47 by the recording paper transport portion 104. Furthermore, the cleaning unit 26 removes and collects toner that is residual on the surface of the photosensitive drum 21 after development and transfer.

Here, the transfer unit 25 is provided with such components as a transfer belt 31, a drive roller 32, an idler roller 33, and an elastic conductive roller 34, and the transfer belt 31 is caused to rotate while spanning the rollers 32 to 34 and other rollers in a tensioned state. The transfer belt 31 has a predetermined resistance value (for example, $1\times10^{9}$ to $1\times10^{13}$ Ω/cm) and transports recording paper that has been placed on its surface. The elastic conductive roller 34 presses against the surface of the photosensitive drum 21 through the transfer belt 31 so that the recording paper on the transfer belt 31 presses against the surface of the photosensitive drum 21. An electric field of a polarity opposite to the charge of the toner image on the surface of the photosensitive drum 21 is applied to the elastic conductive roller 34, and the toner image on the surface of the photosensitive drum 21 is transferred to the recording paper on the transfer belt 31 due to the opposite polarity electric field. For example, when the toner image has a charge of a negative (−) polarity, the elastic conductive roller 34 is subjected to an electric field having a positive (+) polarity.

The fixing apparatus 27 is provided with a hot roller 35 and a pressure roller 36. A pressure-applying member not shown in the drawings is arranged at both ends of the pressure roller 36 so that the pressure roller 36 is pressed into contact with the hot roller 35 with a predetermined pressure. When the recording paper is transported to a pressing region (referred to as a fixing nip portion) between the hot roller 35 and the pressure roller 36, the unfixed toner image on the recording paper is subjected to thermal melting and pressure while the recording paper is being transported by the rollers 35 and 36 such that the toner image fixes to the recording paper.

The recording paper transport portion 104 is provided with components such as a plurality of pairs of transport rollers 41 for transporting the recording paper, a pair of registration rollers 42, a transport path 43, reverse transport paths 44*a* and 44*b*, a plurality of branching claws 45, and a pair of discharge rollers 46.

In the transport path 43, the recording paper is taken in from the paper feed portion 105, then the recording paper is transported until the leading edge of the recording paper reaches the registration rollers 42. At this time the registration rollers 42 are being temporarily stopped, and therefore the leading edge of the recording paper reaches and contacts the registration rollers 42 and the recording paper flexes. Due to the elastic force of the flexed recording paper, the leading edge of the recording paper aligns parallel to the registration rollers 42. After this, rotation of the registration rollers 42 commences and the recording paper is transported by the registration rollers 42 to the transfer unit 25 of the print portion 103, then the recording paper is further transported by the discharge rollers 46 to the discharge tray 47.

Stopping and rotation of the registration rollers 42 can be achieved by switching on and off a clutch between the registration rollers 42 and their drive shafts or by switching on and off the motor that is the drive source of the registration rollers 42.

Furthermore, when an image is to be recorded to the back side of the recording paper also, the branching claws 45 are selectively switched so that the recording paper is guided from the transport path 43 into the reverse transport path 44*b*, then transport of the recording paper is caused to stop temporarily, and the branching claws 45 are again switched so that the recording paper is guided from the reverse transport path 44*b* into the reverse transport path 44*a*, and once the back side of the recording paper has been turned over the recording paper returns to the registration rollers 42 of the transport path 43 via the reverse transport path 44*a*.

This manner of transporting the recording paper is referred to as switchback transporting, and switchback transporting allows the back side of the recording paper to be turned over and at the same time switches the leading edge and the trailing edge of the recording paper. Consequently, when the recording paper is turned over and returned, the trailing edge of the recording paper makes contact with the registration rollers 42 such that the trailing edge of the recording paper aligns in parallel to the registration rollers 42, then the recording paper is transported from its trailing edge by the registration rollers 42 to the transfer unit 25 of the print portion 103 and printing is carried out on the back side of the recording paper, then the unfixed toner image on the back side of the recording paper is subjected to thermal melting and pressure by the fixing nip portion between the rollers 35 and 36 of the fixing apparatus 27 such that the toner image fixes onto the back side of the recording paper, after which the recording paper is transported to the discharge tray 47 by the discharge rollers 46.

Sensors that detect the position and the like of the recording paper are arranged in various locations in the transport path 43 and the reverse transport paths 44*a* and 44*b*, and the transport and positioning of the recording paper are carried out by performing drive control on the transport rollers and the registration rollers based on the positions of the recording paper detected by the various sensors.

The paper feed portion 105 is provided with a plurality of paper feed trays 51. Each of the paper feed trays 51 is a tray for storing recording paper and these are provided in a lower portion of the image forming apparatus 100. Furthermore, each of the paper feed trays 51 is provided with a pickup roller or the like for withdrawing the recording paper sheet by sheet and recording paper that has been withdrawn is fed to the transport path 43 of the recording paper transport portion 104.

Since the image forming apparatus 100 is aimed at high speed print processing, each of the paper feed trays 51 has a capacity capable of storing from 500 to 1,500 sheets of standard size recording papers.

Furthermore, at a lateral surface of the image forming apparatus 100 are provided a large capacity cassette (LCC) 52, which makes it possible to store large volumes of multiple types of recording paper, and a manual paper feed tray 53 for supplying recording paper of mainly nonstandard sizes.

The discharge tray 47 is arranged at a lateral surface on an opposite side to the manual paper feed tray 53. Instead of the discharge tray 47, configurations in which post processing devices of the recording paper (stapling, punching and the like) or a plurality of levels of discharge trays are arranged as options are also possible.

In the image forming apparatus 100 as above, the print processing speed is increased to improve the usefulness thereof. For example, when using standard A4 size recording paper, the transport speed of the recording paper is set to 110 sheets/min (a processing speed of 540 mm/sec).

When the transport speed or the processing speed of the recording paper is increased in the fixing apparatus 27, there is a tendency for a sufficient amount of heat to become unable to be applied to the recording paper that passes through the fixing nip portion between the hot roller 35 and the pressure roller 36, and for the surface temperature of the rollers 35 and 36 to drop, and if this is ignored, deficiencies occur in the fixing of the toner image to the recording paper.

For this reason, in the fixing apparatus 27, a heater is installed internally to both the rollers 35 and 36 to heat the rollers 35 and 36.

More Specific Description of the Fixing Apparatus 27

Figure 2:
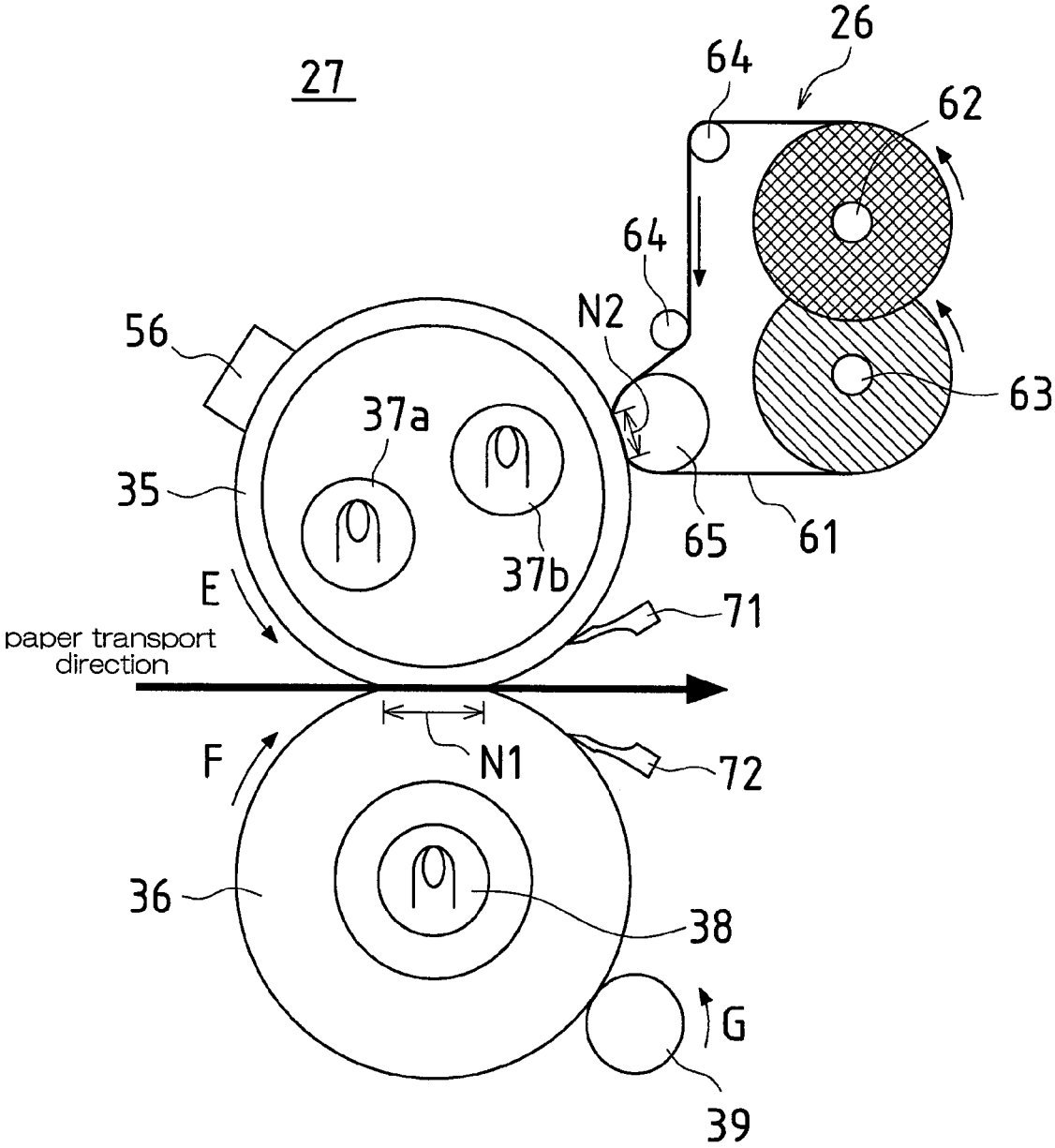
FIG. 2 is a cross-sectional view that schematically illustrates the fixing apparatus as viewed laterally.

FIG. 2 is a cross-sectional view that schematically illustrates the fixing apparatus 27 as viewed laterally. The fixing apparatus 27 is provided with the hot roller 35, the pressure roller 36, the cleaning unit 26 for removing toner that has adhered to the surface of the hot roller 35, a metal roller 39 for removing toner (smeared toner) that has adhered to the surface of the pressure roller 36, and paper separation claws 71 and 72 respectively provided at surfaces of the hot roller 35 and the pressure roller 36.

The cleaning unit 26 is provided with a feed-out roller 62 onto which is wound a web sheet 61 constituted by a thin cloth (approximately 40 μm thick) impregnated with an oil (silicone oil), a take-up roller 63 to which the leading edge of the web sheet 61 is connected, a plurality of tension rollers 64 that apply tension to the web sheet 61 along the transport path of the web sheet 61 from the feed-out roller 62 to the take-up roller 63, and a pressing roller 65 that presses the web sheet 61 onto the hot roller 35 between the feed-out roller 62 and the take-up roller 63, and residual toner sticking to the surface of the hot roller 35 is wiped off and removed by the web sheet 61 being pressed against the surface of the hot roller 35 by the pressing roller 65.

The web sheet 61 is pressed against the surface of the hot roller 35 by the pressing roller 65 at a nip region N2 between the pressing roller 65 and the hot roller 35. A portion of the web sheet 61 at the nip region N2 becomes smeared by residual toner on the surface of the hot roller 35, and when removal of residual toner by this portion of the web sheet 61 becomes difficult, the feed-out roller 62 and the take-up roller 63 are rotated by a fixed amount so that the web sheet 61 is fed out from the feed-out roller 62 to the take-up roller 63 by a fixed amount, thereby renewing the portion of the web sheet 61 at the nip region and making it possible to remove residual toner with this new portion of the web sheet 61. In this way, the portion of the web sheet 61 at the nip region N2 is renewed, and removal of residual toner by the new portion of the web sheet 61 is made possible.

Furthermore, when for each time a fixed amount of toner is consumed and it is deemed that removal of residual toner by the portion of the web sheet 61 of the nip region N2 has become difficult, the feed-out roller 62 and the take-up roller 63 are rotated by a fixed amount to renew the portion of the web sheet 61 at the nip region N2. Consequently, the feed-out roller 62 and the take-up roller 63 are intermittently rotationally driven.

The metal roller 39 is arranged in a manner contacting an outer circumferential surface of the pressure roller 36 so as to be idly rotated. A multitude of indentations are formed on the surface of the metal roller 39 such that toner that has adhered to the surface of the pressure roller 36 (smeared toner) is collected in these indentations.

The paper separation claws 71 and 72 are arranged on a downstream side from a fixing nip portion N1 in the rotation direction of the rollers 35 and 36. The paper separation claws 71 and 72 are swingably or elastically supported near their base ends, and the leading edge side of the paper separation claws 71 and 72 apply a biasing force due to their elastic members against the rollers 35 and 36 respectively such that the leading edge vicinity of each of the paper separation claws 71 and 72 presses lightly against the surface of the rollers 35 and 36 respectively. When a recording paper is wound onto either of the rollers 35 and 36, the leading edge of the recording paper is separated by the leading edge of either of the paper separation claws 71 and 72 and the recording paper is peeled off from the roller surface. In this way, jamming of the recording paper is prevented.

The rollers 35 and 36 press against each other with a predetermined pressing force (for example, 600 N) and the fixing nip portion N1 is formed between these. The length of the fixing nip portion N1 (the length along the rotation direction of the rollers 35 and 36) is set to 9 mm for example. The rollers 35 and 36 rotate while being heated to a prescribed fixing temperature (for example 180° C.) and a toner image on a recording paper P that passes through the fixing nip portion N1 is thermally melted.

The hot roller 35 is a roller having a three-layer structure in which an elastic layer is provided on an outer surface of its core and a mold release layer is formed on an outer surface of the elastic layer. A metal such as iron, stainless steel, aluminum, or copper for example, or an alloy of these or the like, is used for the core. Furthermore, a silicone rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

Two halogen heaters 37*a* and 37*b*, which are heat sources for heating the hot roller 35, are provided inside the hot roller 35 (inside the core).

Like the hot roller 35, the pressure roller 36 is also a roller having a three-layer structure that is constituted by a core of a metal such as iron, stainless steel, aluminum, or copper or an alloy of any of these, an elastic layer of a silicone rubber or the like on a surface of the core, and further still a mold release layer thereon of PFA or PTFE or the like. And a halogen heater 38 for heating the pressure roller 36 is also provided inside the pressure roller 36 (inside the core).

Furthermore, a thermistor 56 is arranged near the surface of the hot roller 35 and the surface temperature of the hot roller 35 is detected by the thermistor 56.

Here, the shaft of the hot roller 35 is rotationally driven by a motor and a power transmission mechanism or the like (not shown in drawings) and rotates in a direction indicated by arrow E. Due to being pressed against the hot roller 35, the pressure roller 36 is idly rotated in a direction indicated by arrow F. Due to being pressed against the pressure roller 36, the metal roller 39 is idly rotated in a direction indicated by arrow G.

Furthermore, the halogen heaters 37*a*, 37*b*, and 38 of the hot roller 35 and the pressure roller 36 are controlled based on the surface temperature of the hot roller 35 detected by the thermistor 56 so as to regulate the surface temperatures of the hot roller 35 and the pressure roller 36. In this way, the surface temperatures of the rollers 35 and 36 are controlled appropriately and the toner image on the recording paper can be fixed reliably.

In the fixing apparatus 27 of the above-described configuration, the recording paper that has wound onto the hot roller 35 is forcibly peeled off by the paper separation claw 71, but at the time the paper is forcibly peeled off by the paper separation claw 71 the melted toner that is adhering onto the hot roller 35 adheres to the paper separation claw 71. The melted toner adhering to the paper separation claw 71, when a certain amount of it has accumulated on the paper separation claw 71, separates from the paper separation claw 71, moves in reverse to the hot roller 35, reaches the cleaning unit 26, and is collected by the cleaning unit 26.

Furthermore, when the recording paper passes through the fixing nip portion N1 in a case of double sided printing, since there is a toner image on the pressure roller 36 side also, toner in a half-melted state adheres to the pressure roller 36 side also due to the surface temperature of the pressure roller 36 and the pressure applied to the fixing nip portion N1 when the recording paper passes through the fixing nip portion N1 in this state. When this adhered toner reaches the metal roller 39, it is collected in the indentations of the metal roller 39.

However, when the speed of the image forming apparatus has been increased and the print processing sheet number becomes large volume, the amount of melted toner that separates from the paper separation claw 71 also becomes large volume, and there is a problem that it escapes past the web sheet 61 of the cleaning unit 26. Consequently, not only does the cleaning of the hot roller 35 become incomplete, toner also moves to the pressure roller 36 at the fixing nip portion N1 such that the amount of melted toner collected by the metal roller 39 also increases. And when toner can no longer be collected by the metal roller 39, this is a cause of back side smearing of the recording paper that is transported in for printing to be carried out next.

Consequently, although it is important to report to the user in advance of the extent of smearing of the metal roller 39, techniques in which notice is given of the replacement time using only an added number of printed sheets as is done conventionally involve the problem that this is merely a notice for reassurance and has extremely low precision.

Accordingly, in the present embodiment, the extent of smearing of the metal roller 39 is detected using a technique that involves monitoring load increases in the fixing drive portion, and notices and warnings are given appropriately for such actions as replacing the metal roller 39 before smearing occurs on the back side of the recording paper.

Figure 11:
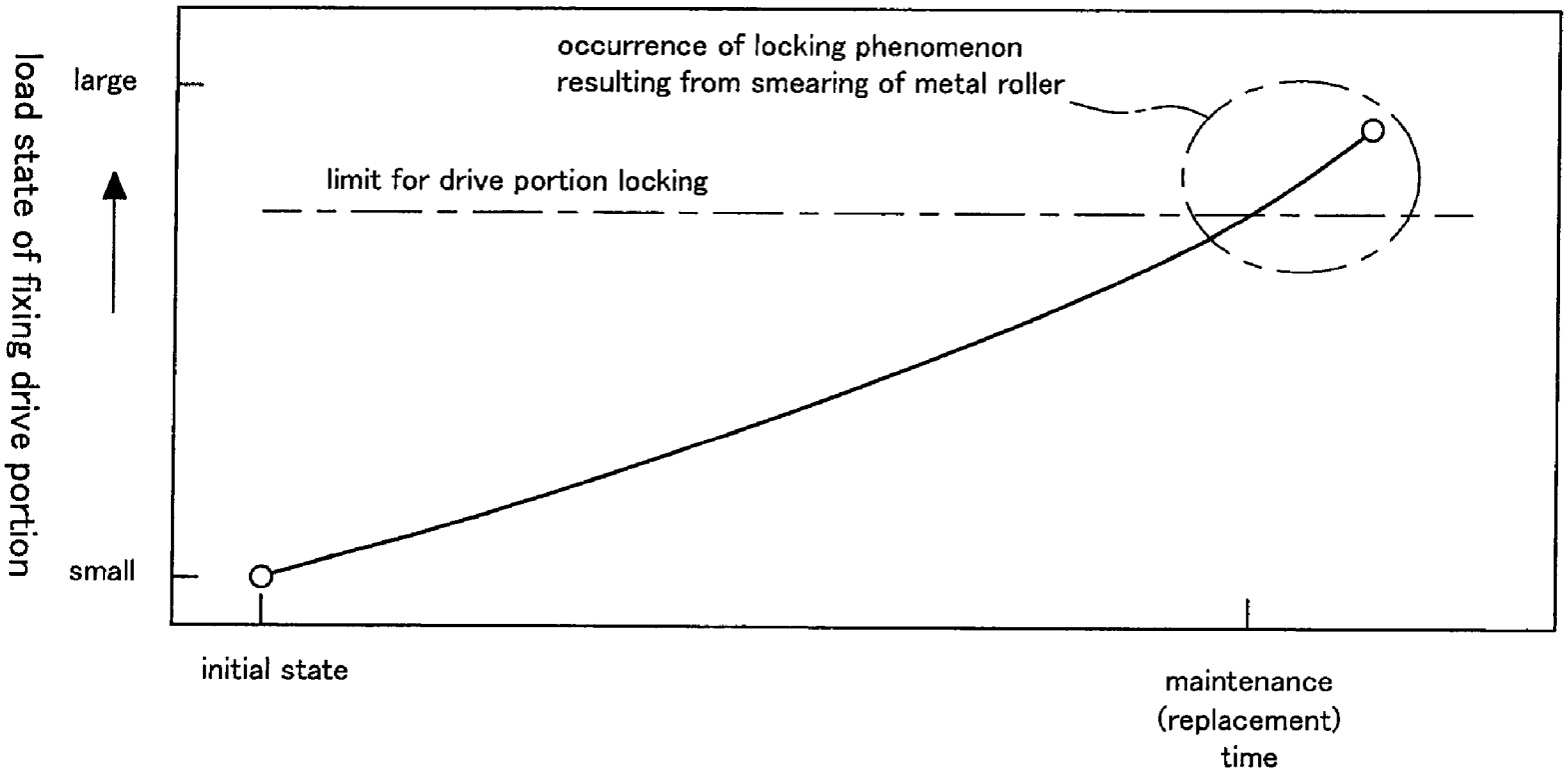
FIG. 11 is an explanatory diagram showing a relationship between smearing of the metal roller and a locking phenomenon of the fixing drive source.

That is, as shown in FIG. 11, the load state of the fixing drive portion is such that the load gradually increases from an initial state of an installation time or a maintenance completion time of the image forming apparatus. As described earlier, the hot roller 35, the pressure roller 36, the web cleaning unit 26, which is the cleaning member for the hot roller 35 side, and the metal roller 39, which is the cleaning member for the pressure roller 36 side, are arranged as rotating members in the fixing apparatus 27. Of these, the web cleaning unit 26 is rotated at a same velocity as the hot roller 35 using independent driving so that an unsoiled, fresh sheet is always supplied to the hot roller 35 surface, and therefore a load increase at the nip region N2 between the web cleaning unit 26 and the hot roller 35 is inconceivable. Furthermore, the surface of the hot roller 35 is cleaned by the web cleaning unit 26 and the surface of the pressure roller 36 is also cleaned by the metal roller 39, and therefore as long as the cleaning is carried out reliably, there is little probability of a load increase in either of the hot roller 35 or the pressure roller 36 by themselves. Consequently, it is conceivable that a major cause of the load increase in the fixing drive portion is that an outer diameter of the metal roller 39, which is arranged at the circumference of the pressure roller 36 and is idly rotated, increases due to collecting smeared toner, thereby resulting in an increase in the contact pressure between itself and the pressure roller 36. In other words, the extent of smearing of the metal roller 39 is evident as a load increase in the fixing drive portion. The present embodiment gives attention to this point in carrying out drive control of the fixing apparatus 27.

Figure 3:
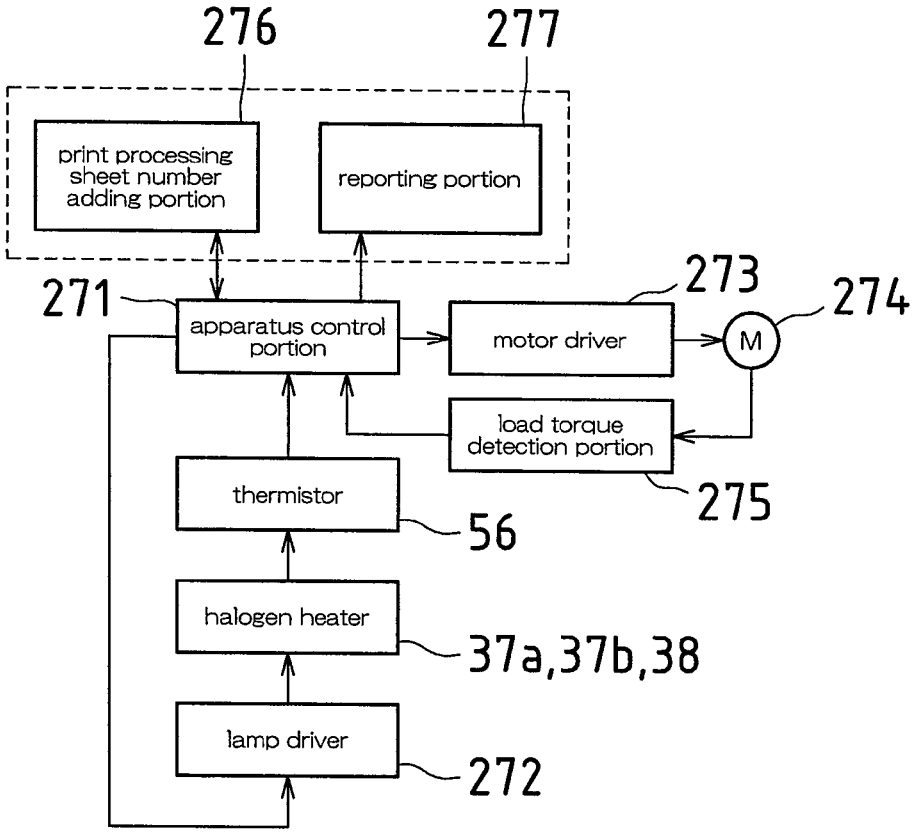
FIG. 3 is a block diagram showing a configuration of a rotation drive control system in a fixing apparatus.

FIG. 3 is a block diagram showing a configuration of a rotation drive control system in the fixing apparatus 27.

An apparatus control portion 271 is provided with a function as a temperature control means that performs control so that the temperature of the hot roller 35 and the pressure roller 36 approach a predetermined fixing temperature by driving a lamp driver 272 during fixing operations (while paper is passing) based on the surface temperature of the hot roller 35 detected by the thermistor 56, and controlling the power to the halogen heaters 37*a*, 37*b*, and 38. Furthermore, the apparatus control portion 271 is provided with a function as a drive control means that controls the rotation driving of the hot roller 35 and the pressure roller 36 by driving a motor driver 273 based on the surface temperature of the hot roller 35 detected by the thermistor 56 to control the rotation driving of a motor 274, which is the drive source of the hot roller 35, and controls the rotation driving of the hot roller 35 and the pressure roller 36 at such times as during a warm up mode and when restoring from a power saving mode.

Furthermore, a load torque detection portion 275 is provided that detects the load torque of the motor 274, and the apparatus control portion 271 is provided with a function as a determination means that determines toner smearing of the metal roller 39 based on the load torque of the motor 274 detected by the load torque detection portion 275. Furthermore, output from a print processing sheet number adding portion 276, which adds a print processing sheet number for which print processing is executed after installation of the image forming apparatus or after maintenance, is fed into the apparatus control portion 271, which is also provided with a function that controls a timing of a determination process by which toner smearing of the metal roller 39 is determined based on a printed sheet number addition value of the print processing sheet number adding portion 276. Further still, the apparatus control portion 271 is provided with a function that reports to the user the determination result of the determination means via a reporting portion 277. For example, manners of reporting by the reporting portion 277 include reporting by displaying a message on a display panel of the image forming apparatus, reporting by a buzzer sound such as an electric buzzer, and reporting by a voice message from an internal speaker using voice synthesis.

Description of Metal Roller Smearing Determination Processing According to the Present Embodiment In the aforementioned configuration, at a predetermined timing that is set in advance, the apparatus control portion 271 sets the rotation velocity of the hot roller 35 to a high-speed rotation, which is higher than the processing velocity by a fixed velocity that is set in advance, then determines the extent of smearing of the metal roller 39 based on the load torque detected by the load torque detection portion 275 at this time.

Here, the rotation velocity of the high-speed rotation is set within a range of 1.3 to 2.0 times the processing velocity. When the rotation velocity of the high-speed rotation is within a range of 1 to 1.3 times the processing velocity (but less than 1.3 times), no major difference occurs between the load torques and therefore there is a possibility that a sufficient detection accuracy will not be obtainable. And when it exceeds 2.0 times, since the hot roller 35 and the pressure roller 36 then undergo considerably high-speed rotation, there is a possibility that the surfaces of the rollers 35 and 36 will be damaged by the paper separation claws 71 and 72 that contact the surfaces of the rollers 35 and 36. Thus, from the perspectives of detection accuracy and preventing component damage, it is preferable that the rotation velocity of high-speed rotation is set to within a range of 1.3 to 2.0 times, and more preferably to within a range of 1.3 to 1.5 times, the processing velocity.

Figure 4:
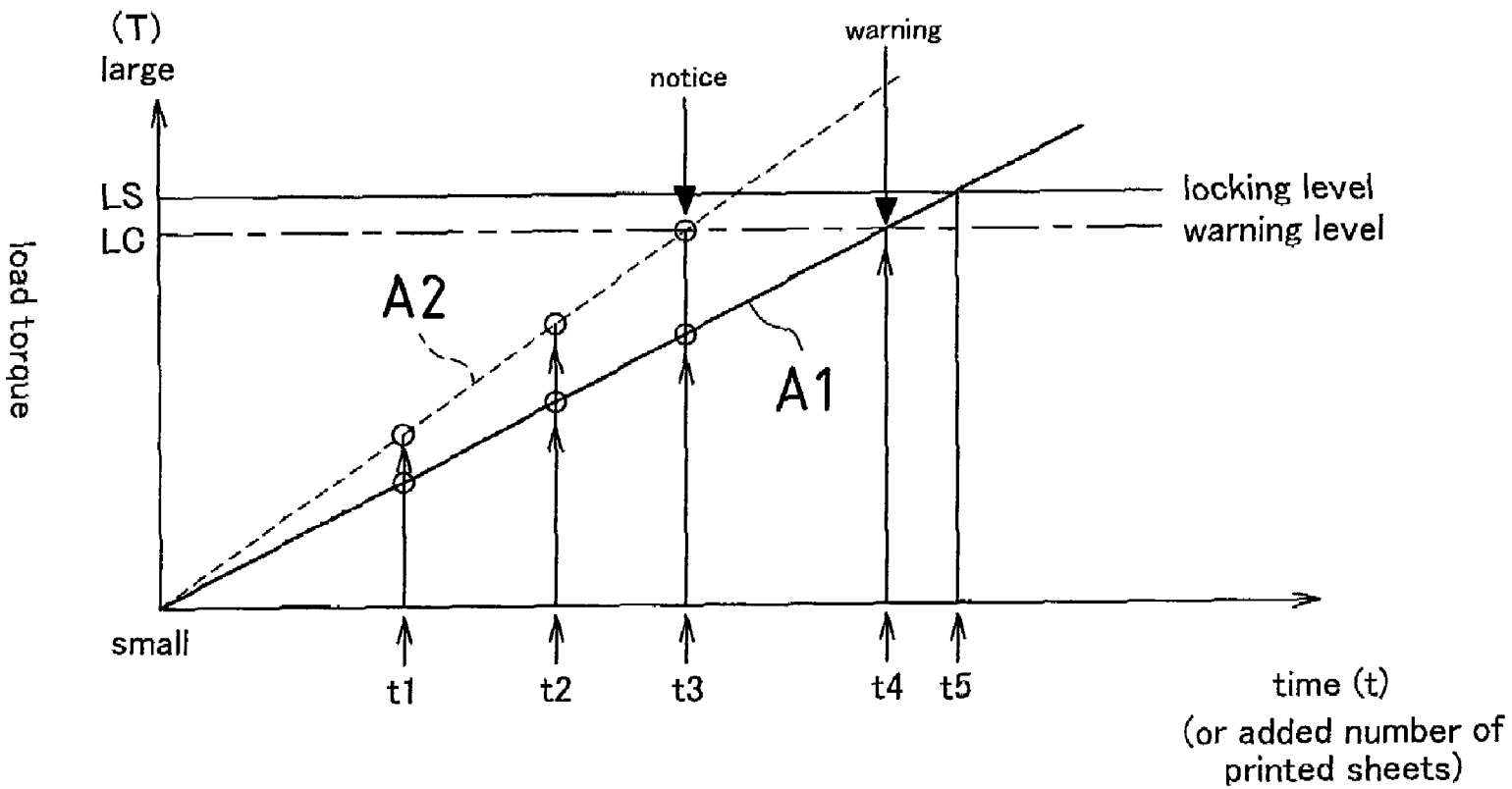
FIG. 4 is an explanatory diagram showing a relationship between smearing of the metal roller and a locking phenomenon of a motor, which is a fixing drive source.

FIG. 4 is an explanatory diagram showing a relationship between smearing of the metal roller 39 and a locking phenomenon of the motor 274, which is the fixing drive source.

As shown in FIG. 4, the load torque of the motor 274, which is the drive source of the hot roller 35, gradually increases from an initial state of an installation time or a maintenance completion time of the image forming apparatus. Although the increases are shown as being linear in this example, depending on the printing mode the progression of the extent of smearing of the metal roller is in fact not constant, and therefore it is anticipated that the increases will occur in a somewhat curvilinear manner, but here they are shown as being linear in order to simplify description.

Here, a straight line A1, which is indicated by a solid line in the diagram, represents change in the load torque corresponding to the processing velocity, and a straight line A2, which is indicated by a dashed line, represents change in the load torque during high-speed rotation of for example 1.5 times the processing velocity. Furthermore, in this graph are set a locking level Ls, at which the image forming apparatus becomes locked, and a warning level Lc slightly below this level. These levels are obtained by testing in advance the load torque when the driving of the fixing apparatus 27 is stopped due to increased load to the drive source while actually driving the image forming apparatus to carry out printing operations, and the load torque level at this time is set as the locking level Ls and a slightly lower level than the locking level Ls is set as the warning level Lc.

Here, at a timing of a time t3 for example, when the apparatus control portion 271 sets the rotation velocity of the hot roller 35 to high-speed rotation, the load torque at high-speed rotation reaches the warning level Lc and therefore a notice report is carried out at this time via the reporting portion 277. Furthermore, when the load torque reaches the warning level Lc (a time t4) with the rotation velocity during print processing, the apparatus control portion 271 puts out a warning report at this time via the reporting portion 277.

It should be noted that in the present embodiment, the aforementioned predetermined timings may be set to one or more of any of three timings (that is, combinations are possible) that include the time of a post-printing rotation process in which rotation is performed immediately after completion of print processing, the time of commencement of motor driving for warming up, and the time of restoring from a power saving mode.

When the predetermined timing is set to during a post-printing rotation process in which rotation is performed immediately after completion of print processing, there is an advantage in that in a case where a lot of smeared toner has newly adhered to the metal roller 39 due to the immediately previous print processing, the state of adherence thereof can be determined promptly.

Furthermore, when the predetermined timing is set to during commencement of motor driving for warming up, at this point in time the hot roller 35 and the pressure roller 36 are both in a low temperature state and the toner that has adhered to the metal roller 39 has definitely hardened. Thus there is an advantage in that by carrying out high-speed rotation in this state, the influence of smeared toner adhered to the metal roller will more clearly be easily apparent as a change in the load torque of the drive source, and therefore the state of smearing of the metal roller 39 can be detected more accurately.

Furthermore, when the predetermined timing is set to during restoring from a power saving mode, at this point in time the hot roller 35 and the pressure roller 36 are both in a low temperature state and the toner that has adhered to the metal roller 39 has definitely hardened in a same manner as for during commencement of motor driving for warming up, which is described above. Thus there is an advantage in that by carrying out high-speed rotation in this state, the influence of smeared toner adhered to the metal roller 39 will more clearly be easily apparent as a change in the load torque of the drive source, and therefore the state of smearing of the metal roller 39 can be detected more accurately.

Of the aforementioned three timings, specific description is given for the present embodiment concerning a process for determining toner smearing in a case where the predetermined timing is set to during a post-printing rotation process in which rotation is performed immediately after completion of print processing, but before this, description is given concerning a conventional drive control method.

Description of Conventional Drive Control Method

Figure 5:
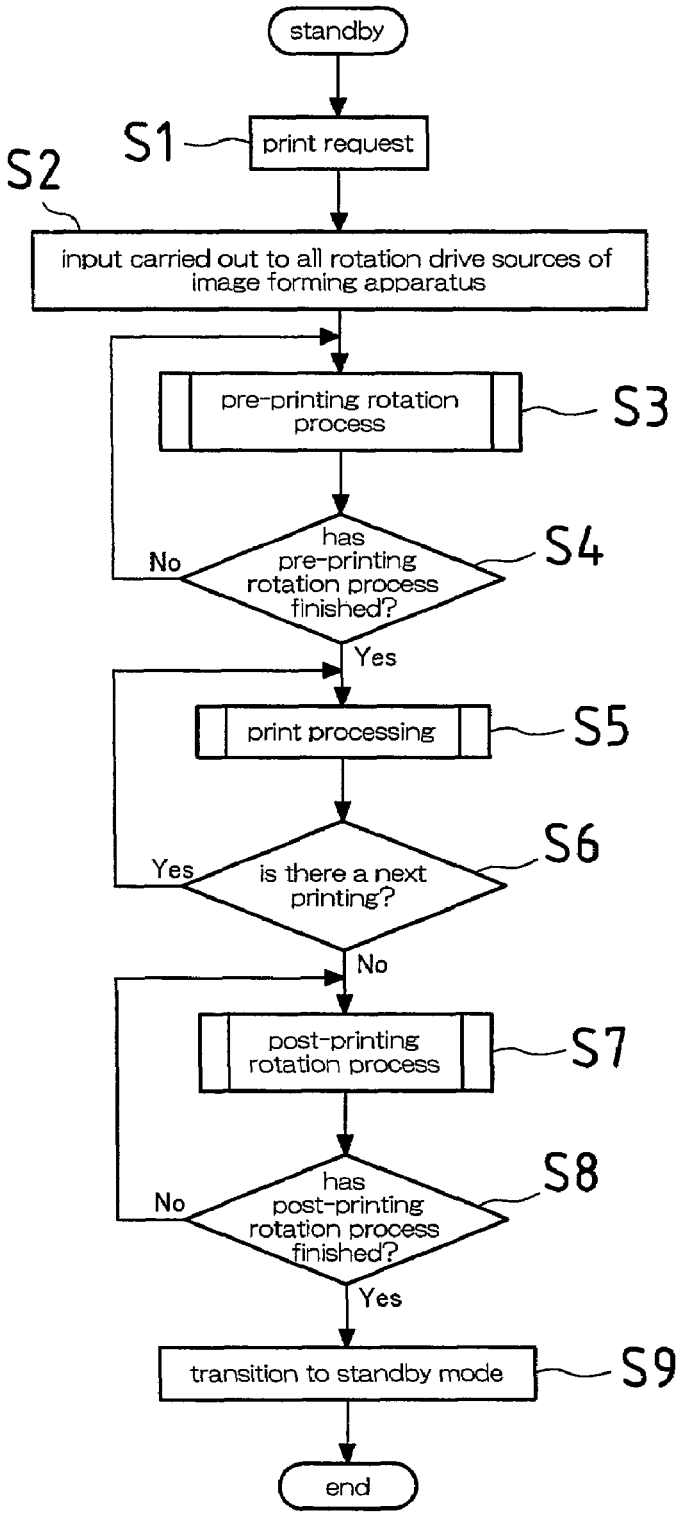
FIG.5 Prior Art
FIG. 5 is a flowchart for describing a conventional drive control method.
Figure 6:
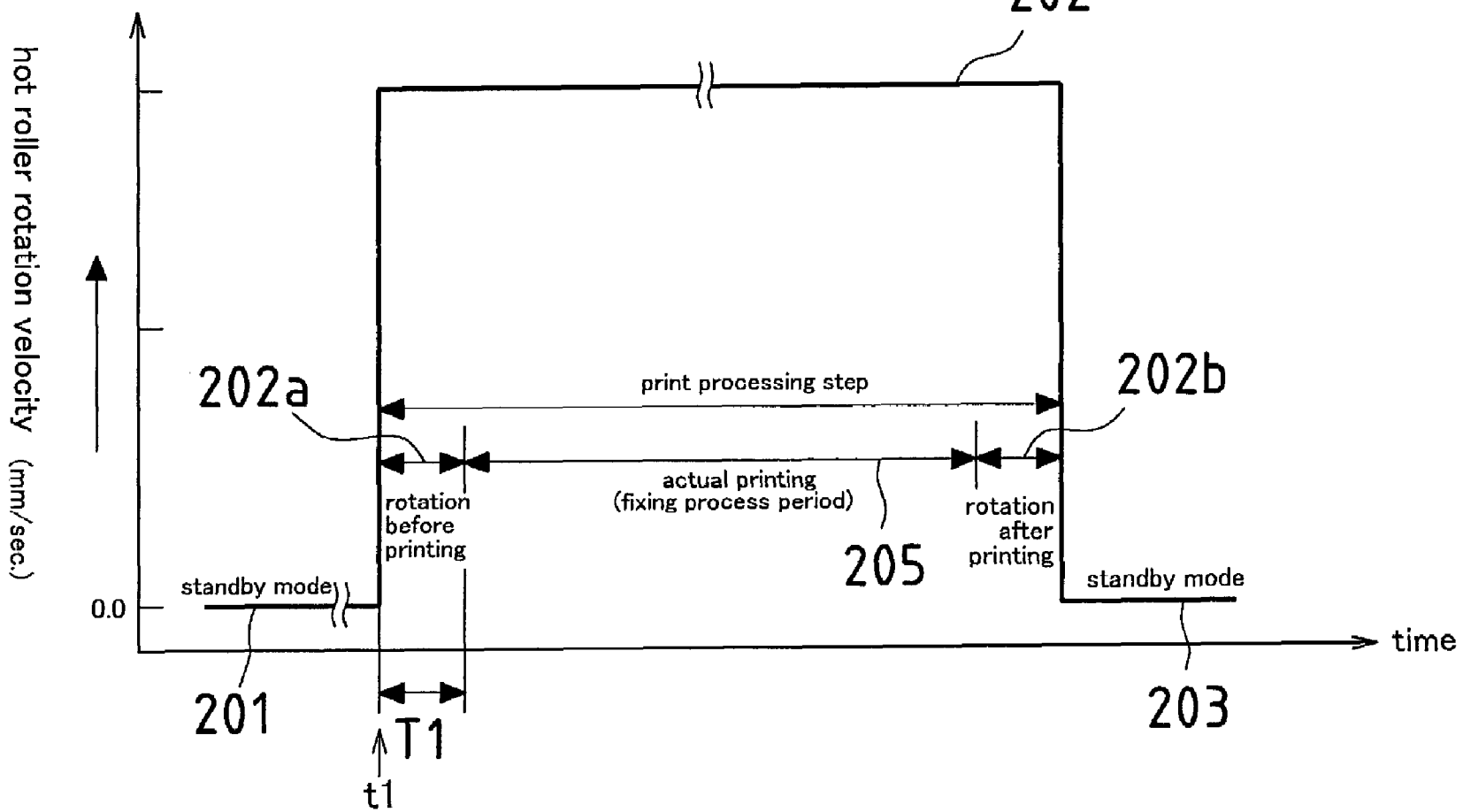
FIG.6 Prior Art
FIG. 6 is timing chart for describing a conventional drive control method.

FIG. 5 is flowchart for describing a conventional drive control method and FIG. 6 is a timing chart.

Before a print request, an image forming apparatus is ordinarily in a standby mode, and all the rotational drive source portions are in an off state. Accordingly, as shown in FIG. 5, the fixing apparatus 27 is also in a standby mode 201 before a print request (before a time t1).

When there is a print request (time t1) to the image forming apparatus during standby (step S1), the apparatus control portion 271 of the image forming apparatus transitions from a standby mode 201 to a print processing step 202 and an operation for print processing commences. That is, input is carried out to all the rotational drive sources of the image forming apparatus (step S2). At this time, the apparatus control portion 271 controls the input voltage to the motor 274, which is the rotational drive source, and carries out a pre-printing rotation process 202*a* in order to carry out initialization of the portions inside the apparatus to be used in print processing by the image forming apparatus (step S3). A time T1 of the pre-printing rotation process is ordinarily a time in which the photosensitive drum 21 rotates at least one rotation or more. In this process, steps are carried out such as initialization of each sensor in the apparatus, charge removal of the surface electric potential residing on the photosensitive drum 21, cleaning of residual toner on the photosensitive drum 21, cleaning of the rollers 35 and 36 of the fixing apparatus 27, determining whether or not the surface temperature of the hot roller 35 has reached the set fixing temperature, and moreover determining whether or not any paper is detained in the paper transport paths of the image forming apparatus.

When the pre-printing rotation process 202*a* is finished (when determined "Yes" at step S4), the apparatus control portion 271 carries out the printing process (step S5) in which the image information for which a print request has been made is made into a manifest image on the recording paper in a transfer step of the photosensitive drum 21. Then, when printing is finished and the recording paper that has passed through the fixing apparatus 27 is discharged to the discharge tray 47, the apparatus control portion 271 confirms whether or not there is printing to be carried out next (step S6), and when there is printing to be carried out next (when determined "Yes" at step S6), the next print processing is carried out (step S5).

On the other hand, when all the printing of the image information for which a print request has been made is finished (when determined "No" at step S6), the apparatus control portion 271 executes the post-printing rotation process 202*b* (step S7) in a same manner as the earlier pre-printing rotation process 202*a*. Here, "post-printing" refers to after the trailing edge of the final paper for the print request has passed through the fixing nip portion N1. Then, when the post-printing rotation process 202*b* is finished (when determined "Yes" at step S8), a transition is made again to the standby mode 203 (step S9). That is, all the rotational drive sources are stopped and only surface temperature control is operated for the hot roller 35. The above has been a description of the drive control method for a conventional image forming apparatus.

Figure 7:
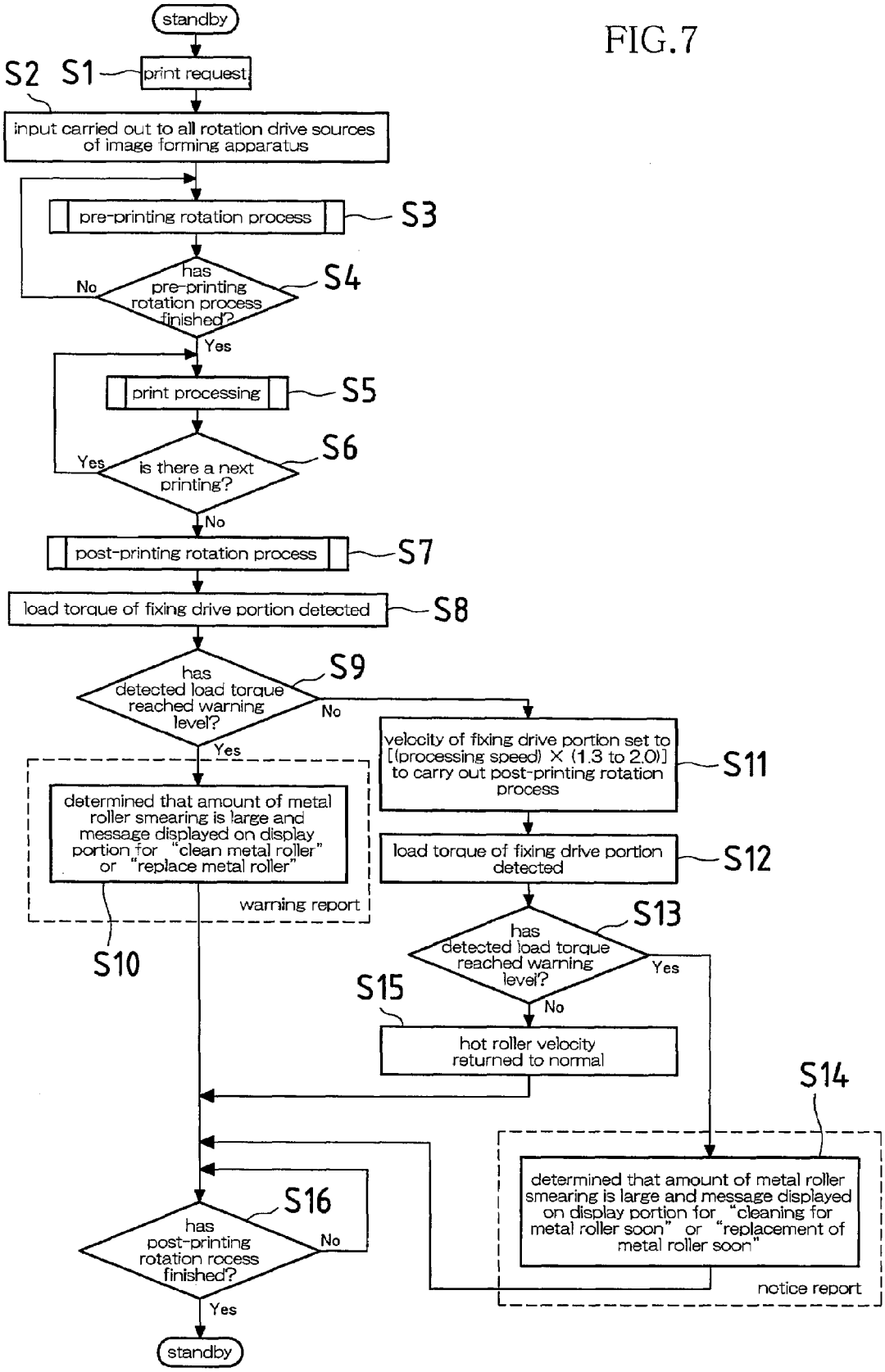
FIG. 7 is a flowchart for describing a toner smearing determination processing method during a post-printing rotation process.
Figure 8:
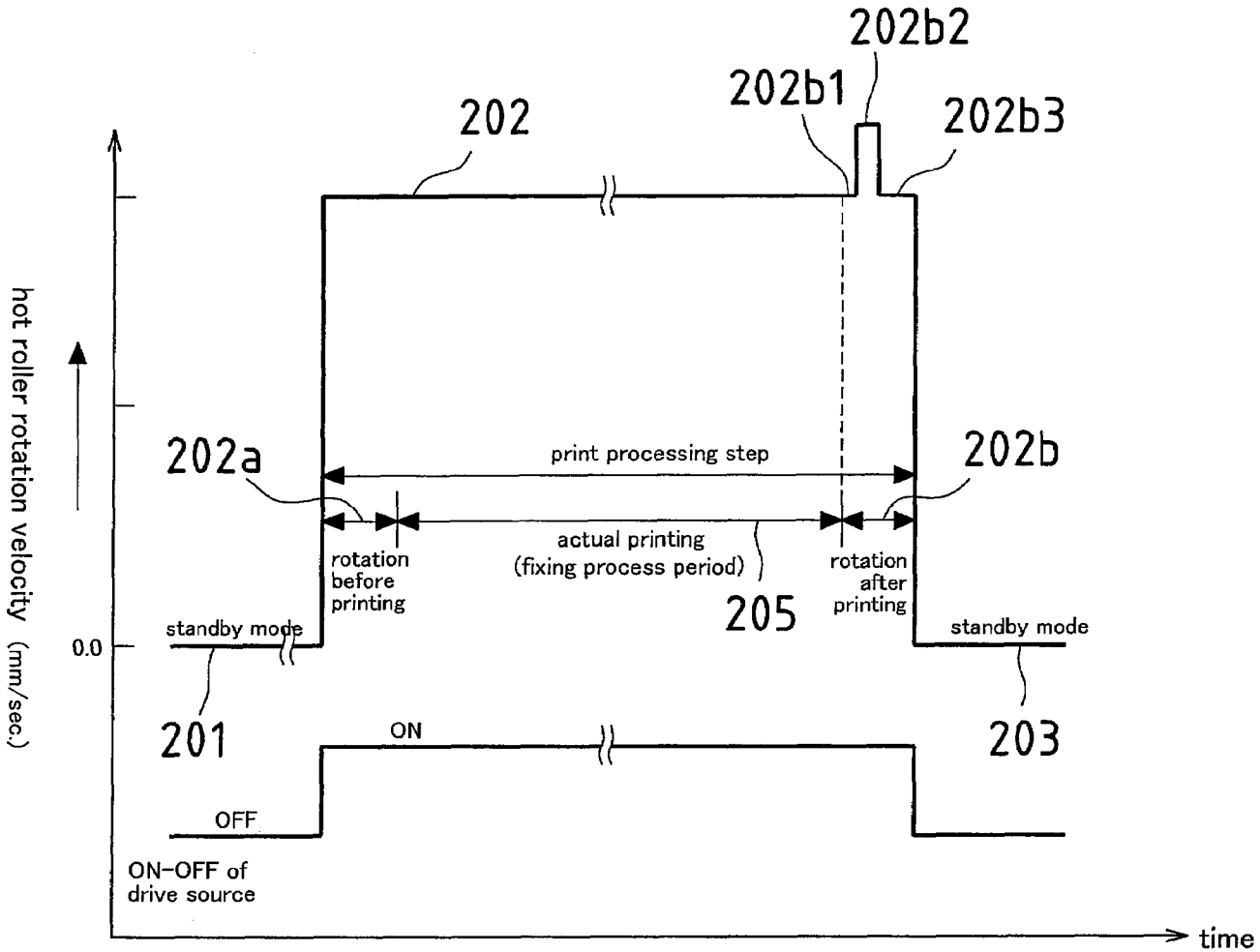
FIG. 8 is a timing chart for describing a toner smearing determination processing method during a post-printing rotation process.

Description of Toner Smearing Determination Process During a Post-Printing Rotation Process in which Rotation is Performed Immediately After Completion ff Print Processing FIG. 7 is a flowchart for describing a toner smearing determination processing method during a post-printing rotation process and FIG. 8 is a timing chart.

Here, the processes from step S1 to step S7 in FIG. 7 are identical to the flowchart for describing the conventional drive control method shown in FIG. 5, and therefore description is given here from step S7 onward.

When the post-printing rotation process commences at step S7, the apparatus control portion 271 leaves the rotation velocity of the hot roller 35 as it is (a state indicated by numerical symbol 202*b*1 in FIG. 8), and detects the load torque of the motor 274 using the load torque detection portion 275 (step S8). The detected load torque at this time is set as La. Then it compares the warning level Lc that has been set in advance and the detected load torque La (step S9). When a result thereof is that the detected load torque La has reached the warning level Lc (that is, a state between times t4 and t5 in FIG. 4), the determination at step S9 becomes "Yes" such that a determination is made that there is a lot of toner smearing of the metal roller 39, and a message prompting for the metal roller 39 to be cleaned or replaced is displayed on the reporting portion 277, which is a display panel for example (step S10). Since this is already a level at which a warning is to be issued, the message at this time is a warning message prompting urgent replacement. After this, the post-printing rotation process is carried out as ordinary and when the post-printing rotation process is finished (when determined "Yes" at step S16), a return is made to the standby state again.

On the other hand, when the detected load torque La has not reached the warning level Lc (that is, a state before (on the left side in FIG. 4) the time t4 in FIG. 4), the determination at step S9 becomes "No." For this reason, the apparatus control portion 271 sets the rotation velocity of the hot roller 35 at this time to high-speed rotation, which is faster by a fixed velocity [=(processing velocity)×(1.3 to 2.0)] (step S11). This state is a state indicated by numerical symbol 202*b*2 in FIG. 8. Then, in this state, the load torque of the motor 274 is detected by the load torque detection portion 275 (step S12). The detected load torque at this time is set as Lb. Then a comparison is made between the warning level Lc that has been set in advance and the detected load torque Lb (step S13). When a result thereof is that the detected load torque Lb has reached the warning level Lc (that is, a state between times t3 and t5 in FIG. 4), the determination at step S13 becomes "Yes" such that a determination is made that there is a lot of toner smearing of the metal roller 39, and a message prompting for the metal roller 39 to be cleaned or replaced is displayed on the reporting portion 277, which is a display panel for example (step S14). Since there is a some leeway before the warning level, the message at this time is set to a notice message reporting that the smearing of the metal roller 39 will soon reach the warning level.

On the other hand, when the detected load torque Lb has not reached the warning level Lc (that is, a state before t3 (on the left side in FIG. 4) in FIG. 4), the determination at step S13 becomes "No." That is, there is still leeway until the warning level. Thus, at this time the apparatus control portion 271 returns the rotation-velocity of the hot roller 35 to its original rotation velocity (step S15), then the post-printing rotation process is carried out as ordinary (a state indicated by numerical symbol 202*b*3 in FIG. 8) and when the post-printing rotation process is finished (when determined "Yes" at step S16), a return is made to the standby state again.

In this manner, in the present embodiment the extent of smearing of the metal roller, which is a cleaning roller, is accurately detected by monitoring torque increases in the motor 274, which is the fixing drive portion, and notices and warnings for such actions as replacing the metal roller are carried out at appropriate timings before smearing occurs on the paper. Furthermore, by carrying out these notices and warnings, appropriate measures can be implemented before reaching the locking level Ls, and therefore it is possible to avoid sudden urgent stoppages of the image forming apparatus.

It should be noted that although in the above-described toner smearing determination processing method a warning level is set to a level slightly lower than the locking level at which the image forming apparatus performs an urgent stop due to an increased load on the motor, and the toner smearing determination process is carried out depending on whether or not the load torque of the high-speed rotation time has reached the warning level, it is also possible to carry out the toner smearing determination process depending on whether or not the load torque of the high-speed rotation time has reached the locking level without setting a warning level in this manner. The warning message (step S10) in this case is carried out in a state in which the image forming apparatus has performed an urgent stop, but the notice message (step S14) before that can be carried out shortly before the image forming apparatus performs an urgent stop, and therefore this timing sufficiently enables the user to make a response.

Description of Toner Smearing Determination Process that Takes into Account a Predetermined Number of Sheets The above-described toner smearing determination process was described as a configuration in which the process is always carried out at a predetermined timing (any of the three above-described timings or a combination thereof), but immediately after the apparatus has been installed or immediately after maintenance has been carried out for example, there is no smeared toner adhering to the metal roller 39, and even when some smeared toner adheres thereafter due to print processing, this is within an allowable range of toner adherence for the metal roller 39. Accordingly, in a case where for example print processing of 100 sheets has been carried out after maintenance, there is no meaning in carrying out the toner smearing determination process during the post-printing rotation process immediately after that printing has finished.

Consequently, this point is taken into account in the present embodiment and can be configured such that in a case where the apparatus has been installed or in a case where maintenance has been carried out, the toner smearing determination process is not carried out at the above-described predetermined timings until after a predetermined number of sheets of printing has been carried out, and after the predetermined number of sheets of printing has been carried out, the toner smearing determination process at the above-described predetermined timings. Hereinafter, s specific working example is set forth to give description regarding a toner smearing determination process that takes into account a predetermined number of sheets.

WORKING EXAMPLE 1

Working example 1 is a working example configured such that in a case where for example maintenance of the apparatus has been carried out, [the toner smearing determination process] is carried out at a predetermined timing after an added number of print processed sheets since completion of the maintenance has reached a predetermined number of sheets that is set in advance.

For example, in a case where the targeted replacement cycle of the metal roller 39 is set to an added number of print processed sheets of 100,000 sheets, the predetermined number of sheets is set to 50,000 sheets for example. Then this is configured such that the above-described toner smearing determination process is not carried out until the added number of print processed sheets added by the print processing sheet number adding portion 276 reaches the predetermined sheet number of 50,000 sheets, and after a stage at which 50,000 sheets has been exceeded and smeared toner has adhered to the metal roller 39 to a certain extent, the toner smearing determination process is carried out at the above-described predetermined timing. In this way it is possible to avoid executing the toner smearing determination process to no purpose at such times as immediately after maintenance.

WORKING EXAMPLE 2

Working example 2 is a working example in which a plurality of types of predetermined number of sheets are set in advance corresponding to the added number of print processed sheets from after maintenance is finished. In this case, with working example 2, a plurality of interval types of predetermined number of sheets is set so as to become a smaller sheet number interval as the commencement of the next maintenance approaches. And the toner smearing determination process by the apparatus control portion 271 is configured to be carried out at the above-described predetermined timings each time after the plurality of types of predetermined number of sheets have been reached respectively.

Figure 9:
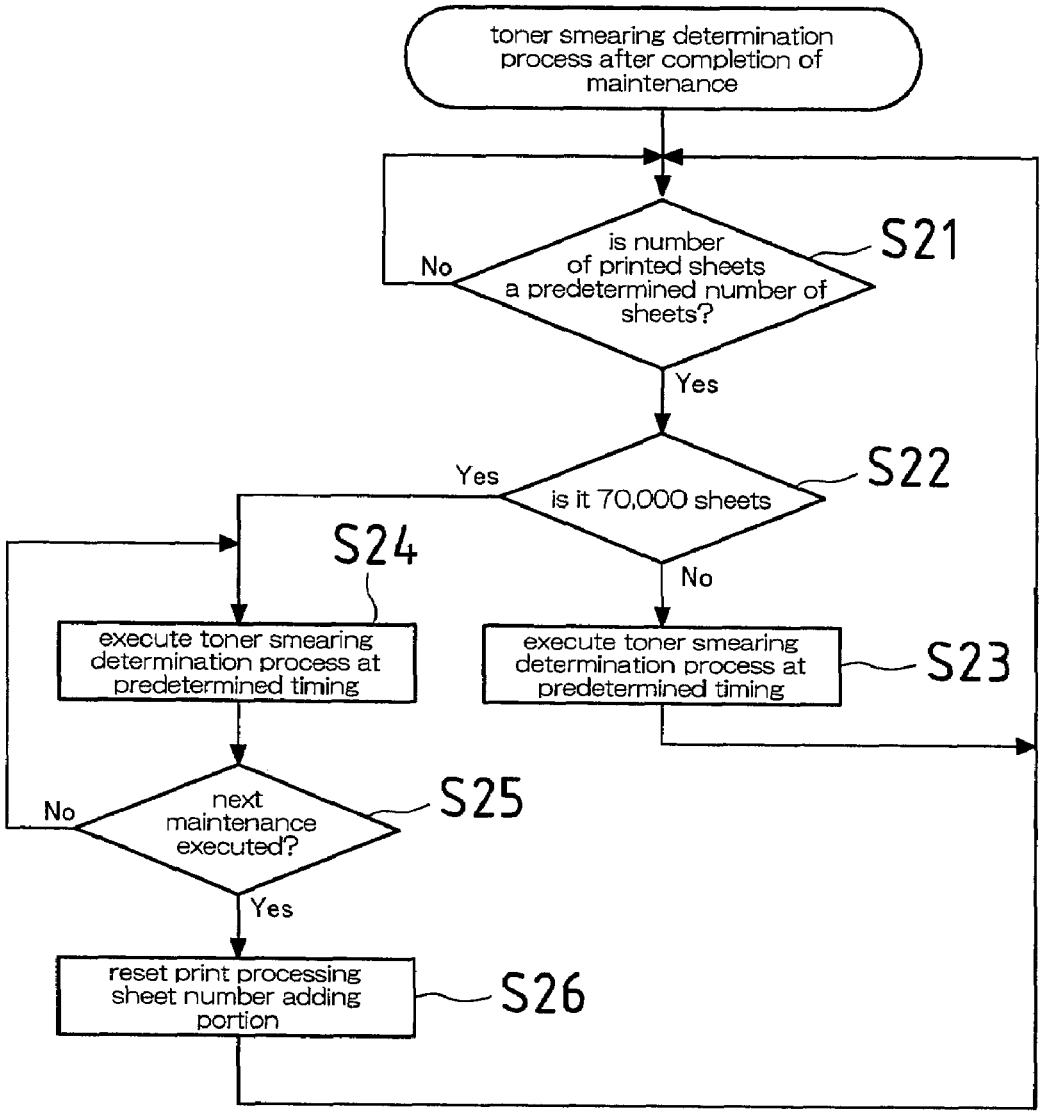
FIG. 9 is a flowchart for describing Working Example 2 of a toner smearing determination processing method that takes into account a predetermined number of sheets.

To give a specific example, five settings are used for the predetermined number of sheets, these being 50,000 sheets, 60,000 sheets, 65,000 sheets, 68,000 sheets, and 70,000 sheets. The apparatus control portion 271 executes the toner smearing determination process in the following manner based on these settings. Hereinafter, description is given with reference to the flowchart shown in FIG. 9.

That is, the apparatus control portion 271 constantly monitors an addition result of the print processing sheet number adding portion 276 to determine whether or not the added number of print processed sheets is one of the predetermined number of sheets (step S21). And when the added number of print processed sheets exceeds 50,000 sheets, which is the first predetermined number of sheets (when determined "Yes" at step S21), a confirmation is then made as to whether the predetermined number of sheets is not exceeding 70,000 sheets (after determined "No" at step S22) after which a first toner smearing determination process is carried out at the predetermined timing (step S23), then the procedure returns to step S21, and a confirmation is made as to whether the added number of print processed sheets has reached the next predetermined number of sheets. That is, after this, the toner smearing determination process is not carried out until the next predetermined number of sheets.

And when the added number of print processed sheets exceeds 60,000 sheets, which is the next predetermined number of sheets (when determined "Yes" at step S21), a confirmation is then made as to whether the predetermined number of sheets is not exceeding 70,000 sheets (after determined "No" at step S22) after which the toner smearing determination process is carried out a second time at the predetermined timing (step S23), then the procedure returns to step S21, and a confirmation is made as to whether the added number of print processed sheets has reached the next predetermined number of sheets. That is, after this, the toner smearing determination process is not carried out until the next predetermined number of sheets.

And when the added number of print processed sheets exceeds 65,000 sheets, which is the next predetermined number of sheets (when determined "Yes" at step S21), a confirmation is then made as to whether the predetermined number of sheets is not exceeding 70,000 sheets (after determined "No" at step S22) after which the toner smearing determination process is carried out a third time at the predetermined timing (step S23), then the procedure returns to step S21, and a confirmation is made as to whether the added number of print processed sheets has reached the next predetermined number of sheets. That is, after this, the toner smearing determination process is not carried out until the next predetermined number of sheets.

And when the added number of print processed sheets exceeds 68,000 sheets, which is the next predetermined number of sheets (when determined "Yes" at step S21), a confirmation is then made as to whether the predetermined number of sheets is not exceeding 70,000 sheets (after determined "No" at step S22) after which the toner smearing determination process is carried out a fourth time at the predetermined timing (step S23), then the procedure returns to step S21, and a confirmation is made as to whether the added number of print processed sheets has reached the next predetermined number of sheets. That is, after this, the toner smearing determination process is not carried out until the next predetermined number of sheets.

And when the added number of print processed sheets exceeds 70,000 sheets, which is the next predetermined number of sheets (when determined "Yes" at step S21), in this case "Yes" is determined also at the next step S22, and therefore processing proceeds to step S24, after which the toner smearing determination process is carried out a fifth time at the predetermined timing.

After this, until the next maintenance is executed (until determined "Yes" at step S25), the apparatus control portion 271 repetitively executes the toner smearing determination process at a predetermined timing (step S24). Then, when the next maintenance is executed (when determined "Yes" at step S25), the apparatus control portion 271 resets the addition value of the print processing sheet number adding portion 276 (step S26) and returns to step S21 again.

WORKING EXAMPLE 3

In the aforementioned working example 2, the plurality of types of predetermined number of sheets, which are set in advance, were set as addition values of the numbers of print processed sheets, but Working Example 3 is a working example in which the toner smearing determination process is carried out in more detail by adding to the addition value an interval value of the numbers of print processed sheets.

Figure 10:
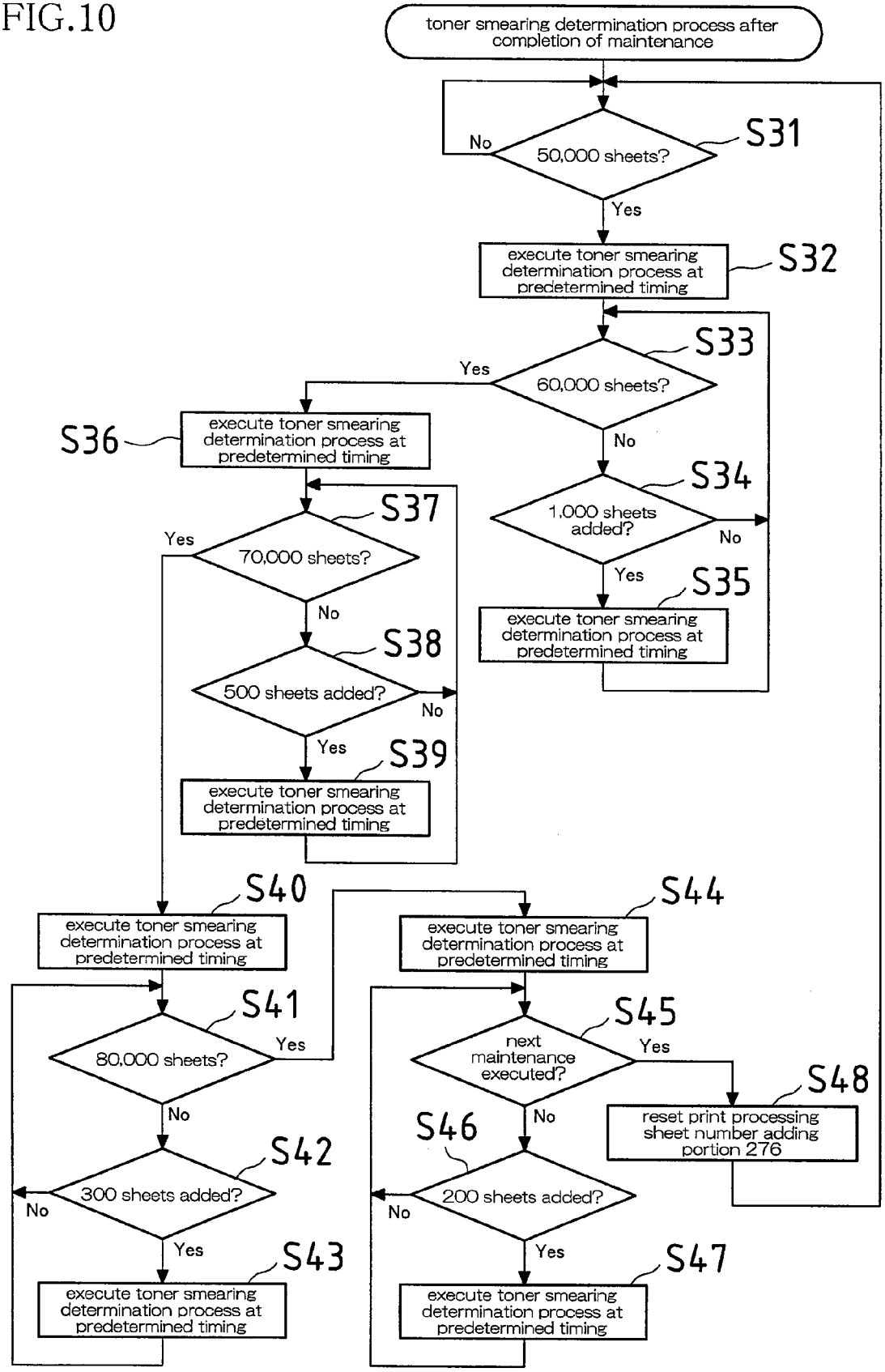
FIG. 10 is a flowchart for describing Working Example 3 of a toner smearing determination processing method that takes into account a predetermined number of sheets.

To set forth a specific example, four settings of predetermined number of sheets are used for example as the addition values, these being 50,000 sheets, 60,000 sheets, 70,000 sheets, and 80,000 sheets, and four settings are used for the interval values of the numbers of print processed sheets associated with these addition values respectively, these being 1,000 sheets, 500 sheets, 300 sheets, and 200 sheets. The apparatus control portion 271 executes the toner smearing determination process in the following manner based on these setting values. Hereinafter, description is given with reference to the flowchart shown in FIG. 10.

That is, the apparatus control portion 271 constantly monitors an addition result of the print processing sheet number adding portion 276 to determine whether or not the added number of print processed sheets has become 50,000 sheets, which is the first of the above-mentioned predetermined number of sheets that have been set (step S31). And when the added number of print processed sheets has become 50,000 sheets (when determined "Yes" at step S31), the toner smearing determination process is carried out at a predetermined timing thereafter (step S32). After this, monitoring is performed as to whether or not the added number of print processed sheets has become 60,000 sheets, which is the next predetermined number of sheets (step S33) and as to whether or not the number of print processed sheets thereafter has become 1,000 sheets, which is the interval that has been set (step S34), and when the number of print processed sheets thereafter is 1,000 sheets (that is, the added number of print processed sheets is 51,000 sheets), (when determined "Yes" at step S34), the toner smearing determination process is carried out at the predetermined timing thereafter (step S35), after which the procedure returns to step S33. That is, the toner smearing determination process is carried out at the predetermined timing thereafter for each 1,000 print processed sheets until the added number of print processed sheets reaches from 50,000 sheets to 60,000 sheets.

After this, when the added number of print processed sheets has become 60,000 sheets (when determined "Yes" at step S33), the toner smearing determination process is carried out at a predetermined timing thereafter (step S36). After this, monitoring is performed as to whether or not the added number of print processed sheets has become 70,000 sheets, which is the next predetermined number of sheets (step S37) and as to whether or not the number of print processed sheets thereafter has become 500 sheets (step S38), and when the number of print processed sheets thereafter is 500 sheets (that is, the added number of print processed sheets is 60,500 sheets), (when determined "Yes" at step S38), the toner smearing determination process is carried out at the predetermined timing thereafter (step S39), after which the procedure returns to step S37. That is, the toner smearing determination process is carried out at the predetermined timing thereafter for each 500 print processed sheets until the added number of print processed sheets reaches from 60,000 sheets to 70,000 sheets.

After this, when the added number of print processed sheets has become 70,000 sheets (when determined "Yes" at step S37), the toner smearing determination process is carried out at a predetermined timing thereafter (step S40). After this, monitoring is performed as to whether or not the added number of print processed sheets has become 80,000 sheets, which is the next predetermined number of sheets (step S41) and as to whether or not the number of print processed sheets thereafter has become 300 sheets (step S42), and when the number of print processed sheets thereafter is 300 sheets (that is, the added number of print processed sheets is 70,300 sheets), (when determined "Yes" at step S42), the toner smearing determination process is carried out at the predetermined timing thereafter (step S43), after which the procedure returns to step S41. That is, the toner smearing determination process is carried out at the predetermined timing thereafter for each 300 print processed sheets until the added number of print processed sheets reaches from 70,000 sheets to 80,000 sheets.

After this, when the added number of print processed sheets has become 80,000 sheets (when determined "Yes" at step S41), the toner smearing determination process is carried out at a predetermined timing thereafter (step S44). After this, monitoring is performed as to whether or not the next maintenance has been executed (step S45) and as to whether or not the number of print processed sheets thereafter has become 200 sheets (step S46), and when the number of print processed sheets thereafter is 200 sheets (that is, the added number of print processed sheets is 80,200 sheets), (when determined "Yes" at step S46), the toner smearing determination process is carried out at the predetermined timing thereafter (step S47), after which the procedure returns to step S45. That is, when the added number of print processed sheets has exceeded 80,000 sheets, the toner smearing determination process is carried out at the predetermined timing thereafter for each 200 print processed sheets until the next maintenance is executed (until determined "Yes" at step S45). Then, when the next maintenance is executed (when determined "Yes" at step S46), the apparatus control portion 271 resets the addition value of the print processing sheet number adding portion 276 (step S48) and returns to step S31 again.

It should be noted that working example 3 necessitates carrying out in parallel and at the same time the counting from the beginning for the added number of print processed sheets and the counting for the interval values of the numbers of print processed sheets. In this case, a function for counting the interval values of numbers of print processed sheets may be added to the print processing sheet number adding portion 276, and it is also possible to newly add an interval value counting portion that counts only the interval values of numbers of print processed sheets. The interval value counting portion is configured such that a count signal is outputted to the apparatus control portion 271 when a preset interval value (1,000 sheets, 500 sheets, 300 sheets, and 20 sheets) is counted, after which the count value is reset automatically and counting of the interval value commences again.

WORKING EXAMPLE 4

In the foregoing working examples 2 and 3, the intervals for executing the toner smearing determination process are set such that they are long immediately after maintenance has been carried out and become shorter as the time for executing the next maintenance approaches, but the intervals for executing the toner smearing determination process may be set as fixed intervals extending through the period from immediately after maintenance has been carried out until the next maintenance is executed. That is, a configuration may be used in which the interval of numbers of print processed sheets is set to 200 sheets for example, and after the added number of print processed sheets since completion of maintenance has exceeded 50,000 sheets for example, the toner smearing determination process is carried out at the predetermined timing thereafter each time 200 sheets are print processed. Even more simply, a configuration may be used in which the toner smearing determination process is carried out at the predetermined timing each time the number of print processed sheets exceeds 200 sheets from the beginning after completion of maintenance.

The present invention can be embodied and practiced in other different forms without departing from the spirit, purport or essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing apparatus comprising:

fixing rollers that fix a toner image that has been transferred onto a paper, a cleaning member that cleans a circumferential surface of one of the fixing rollers using a metal roller that is idly rotated by contacting the circumferential surface of the fixing roller, a drive control means that, at a predetermined timing, sets a rotation velocity of the fixing roller to high-speed rotation that is faster by a predetermined velocity than a rotation velocity during print processing, a load torque detection means that detects a load torque of a drive source of the fixing roller, and a determination means that determines an extent of smearing of the cleaning member based on a load torque detected by the load torque detection means during high-speed rotation by the drive control means.

2. The fixing apparatus according to claim 1, wherein when a load torque of the drive source detected by the load torque detection means during high-speed rotation of the fixing roller is exceeding a warning detection value that has been set based on a load torque detected by the load torque detection means during print processing, the determination means puts out a notice report of notifying that a timing for replacing or cleaning the cleaning member is approaching.

3. The fixing apparatus according to claim 2, wherein when a load torque detected by the load torque detection means during print processing is exceeding the warning detection value, the determination means puts out a warning report of warning that it is time for replacing or cleaning the cleaning member.

4. The fixing apparatus according to claim 1, wherein of a hot roller and a pressure roller that constitute the fixing rollers, the metal roller is contacting the pressure roller.

5. The fixing apparatus according to claim 4, wherein the drive source is a drive source of the hot roller.

6. The fixing apparatus according to claim 1, wherein the predetermined timing is one or more of a time of a post-printing rotation process in which rotation is performed immediately after completion of print processing, and a time of commencement of motor driving for warming up, or a time of restoring from a power saving mode.

7. The fixing apparatus according to claim 1, wherein a rotation velocity of the high-speed rotation is within a range of 1.3 to 2.0 times a rotation velocity during the print processing.

8. The fixing apparatus according to claim 6, wherein when apparatus maintenance has been carried out, high-speed rotation control by the drive control means is carried out at a predetermined timing after an added number of print processed sheets since completion of the maintenance has reached a predetermined number of sheets that is set in advance.

9. The fixing apparatus according to claim 8, wherein a plurality of levels of the predetermined number of sheets are set in advance corresponding to added numbers of print processed sheets from since completion of the maintenance, and high-speed rotation control by the drive control means is carried out at the predetermined timing each time after the plurality of levels of predetermined number of sheets have been reached respectively.

10. The fixing apparatus according to claim 9, wherein a plurality of intervals of predetermined number of sheets is set so as to become a smaller sheet number interval as commencement of a next maintenance approaches.

11. The fixing apparatus according to claim 9, wherein a plurality of intervals of predetermined number of sheets is set to an interval of a fixed number of sheets.

12. An image forming apparatus, wherein the image forming apparatus is equipped with the fixing apparatus according to claim 1.

* * * * *